United States Patent [19]

McCullough, Jr. et al.

[11] Patent Number: 4,897,303

[45] Date of Patent: Jan. 30, 1990

[54] BUOYANT COATED FIBERS

[75] Inventors: Francis P. McCullough, Jr., Lake Jackson; R. Vernon Snelgrove, Damon, both of Tex.

[73] Assignee: The Dow Chemical Company, Midland, Mich.

[21] Appl. No.: 164,605

[22] Filed: Mar. 7, 1988

[51] Int. Cl.[4] ..... D04H 1/58

[52] U.S. Cl. ..... 428/284; 428/280; 428/286; 428/289; 428/290; 428/297; 428/408; 428/903; 428/913; 428/920

[58] Field of Search ..... 428/74, 290, 280, 288, 428/361, 362, 369, 408, 902, 913, 284, 286, 289, 297, 290, 920, 903; 427/393.4, 227

[56] References Cited

U.S. PATENT DOCUMENTS

| | | | |
|---|---|---|---|
| 2,495,636 | 1/1950 | Hoeltzel et al. | 428/74 |
| 3,459,631 | 8/1969 | Hamilton et al. | 428/362 |
| 3,844,877 | 10/1974 | Wessendorf et al. | 428/408 |
| 4,412,675 | 11/1983 | Kawakubo | 267/167 |
| 4,643,931 | 2/1987 | McCullough, Jr. et al. | 428/97 |

*Primary Examiner*—James J. Bell

*Attorney, Agent, or Firm*—John Lezdey

[57] ABSTRACT

A buoyant article which can be used for floatation and/or insulation comprising a coated batting, felt or non-woven web of resilient shape reforming elongatable non-linear carbonaceous fibers, said fibers having a reversible deflection ratio of greater than 1.2:1 and said coating comprising a water insoluble hydrophobic cured or set substance.

18 Claims, No Drawings

BUOYANT COATED FIBERS

FIELD OF THE INVENTION

The present invention relates to a novel buoyant low density open-celled fibrous structure having good insulating properties. More particularly, the invention relates to light weight flame retardant non-linear carbonaceous fiber structures which are coated with a water insoluble hydrophobic substance and are useful in articles of clothing, sleeping bags, floatation equipment and the like, to provide insulation and buoyancy.

BACKGROUND OF THE INVENTION

Advanced thermal personal protection articles which use insulation batting materials will have to meet demands for an acceptable environment. Flammability, smoke toxicity, mold and mildew formation, loss of insulation performance when wet, dust and other irritants are only a short list of the problems found with the current materials used as insulation for personal articles such as garments and sleeping bags.

The prior art has used fowl down and feathers, asbestos, wool, polyester and polypropylene fibers and various foam materials such as polyurethane foam as thermal insulation for many applications. Fowl down is the most desired light weight thermal insulation material. Current thermal protection materials most commonly used as substitutes for down are thermoplastic fibrous materials which provide fair to adequate thermal insulation at some additional weight, but are less than acceptable because they are flammable, melt when subjected to modest amounts of heat and can generate toxic fumes when burned. In addition, such prior art materials absorb moisture and water and none have the capabilities of forming buoyant light weight structures even when coated with water-repellant materials as provided by the present invention.

There is a further need for buoyant light weight non-wettable insulation in aircraft which is effective for thermal changes and for sound absorbency. Current use of coated fiberglass results in additional weight for the aircraft and does little to help to maintain buoyancy of small aircraft in water.

U.S. Pat. No. 4,167,604 to William E. Aldrich discloses the use of crimped hollow polyester filaments in a blend with down in the form of a multiple ply carded web which is treated with a thermosetting resin to form a bat having thermal insulating characteristics. The web, however, does not have any buoyancy and has moisture retention properties.

U.S. Pat. No. 4,321,154 to Francois Ledru relates to high temperature thermal insulation material comprising insulating mineral fibers and pyrolytic carbon. To make the insulation light weight, an expanding agent is utilized or hollow particles such as microspheres are utilized. Although light weight, this material is not buoyant and absorbs moisture.

U.S. patent application Ser. No. 108,255 filed Oct. 13, 1987, entitled "Sound and Thermal Insulation" of McCullough, et al, which is herewith incorporated by reference, discloses non-linear, carbonaceous fibers and fibrous structures which can be utilized in the present invention.

U.S. Pat. No. 4,371,585 to Memon, which is herewith incorporated by reference discloses a process for applying a silicone or siloxane coating which may be utilized in the present invention.

The brochure of the Dow Corning Corporation entitled "Dow Corning Materials For High Technology Applications, 1986", which is herewith incorporated by reference, discloses silicone products including silicone elastomers, organofunctional silanes, chlorosilanes, etc. which can be used as coating material in preparing the buoyant structures of the invention.

SUMMARY OF THE INVENTION

In accordance with the present invention there is provided a buoyant article for insulating a party against the weather and/or temperature wherein the article contains a multiplicity of buoyant coated light weight non-linear carbonaceous fibers or fibrous insulation materials which possess both excellent thermal insulation, and good reversible compressibility. More particularly, the present invention is concerned with a buoyant open-celled fibrous structure for insulation and/or floatation comprising a batting, felt or non-woven web of resilient shape reforming elongatable non-linear carbonaceous fibers having a reversible deflection of at least about 1.2:1, an aspect ratio (1/d) greater than 10:1 and a limited oxygen index value greater than 40. The fibrous structure is coated with a water insoluble hydrophobic substance.

Surprisingly, the article of the invention requires less than about 10% by weight of the coating material in order to achieve buoyancy. A greater amount can be utilized however it is not necessary for achieving the buoyancy requirements of the invention. Depending upon the hydrophobic coating substance utilized and the utility of the fibrous structure, it has been unexpectedly found that only the outer surface of carbonaceous fibrous structure need be coated in order to achieve desirable floatation characteristics.

The coating material may comprise any water insoluble hydrophobic material which can be cured or set. The coating material may comprise any curable hydrophobic materials including haloaliphatic resins, polysiloxanes, silicone products including rubbers and elastomers, waxes and the like.

It is understood that the term "open-celled fibrous structure" means that the porosity of the structure is maintained and that the structure can still be opened.

DESCRIPTION OF THE PREFERRED EMBODIMENTS

In accordance with one embodiment of the invention, the buoyant and insulative articles comprise a coated open-celled batting formed from non-linear resilient elongatable carbonaceous fibers having a reversible deflection ratio of greater than about 1.2:1 and an aspect ratio (1/d) of greater than 10:1. The carbonaceous filaments used in the present invention contain at least 65% carbon and are described in copending application Ser. No. 108,255. The carbonaceous fibers preferably possess a sinusoidal or a coil-like configuration or a more complicated structural combination of the two in order to provide the compression reforming characteristics required in the invention. The coating materials which can be used in the present invention may consist of any light weight water insoluble settable or curable substance that can be deposited so as to adhere to the fibers or filaments. Suitable substances include high molecular weight waxes, haloaliphatic resins, thermoset and thermoplastic resins, ionomers, silicone products, polysiloxanes, and the like.

Preferred coatings include polytetrafluoroethylene, polyvinylidene fluoride, polyvinyl chloride, etc.

The carbonaceous fibers which are used in the invention may be prepared by heat treating a suitable stabilized precursor material such as that derived from an assembly of stabilized polyacrylonitrile based materials or pitch based materials (petroleum or coal tar) or other polymeric materials which can be made into a non-linear fiber or filament structure or configurations and are thermally stable.

For example, in the case of polyacrylonitrile (PAN) based fibers, the fibers are formed by melt or wet spinning a suitable fluid of the precursor material having a normal nominal diameter of from about 4 to 25 microns, collected as an assembly of a multiplicity of continuous filaments in tows, which are stabilized (by oxidation in the case of PAN based fibers) in the conventional manner, and the stabilized tows (or staple yarn made from chopped or stretch broken fiber staple) are thereafter formed into a coil-like and/or sinusoidal form. The fabric or cloth is thereafter heat treated, in a relaxed and unstressed condition, at a temperature of from about 525 to about 750 degrees C., in an inert atmosphere for a period of time to produce a heat induced thermoset reaction wherein additional cross-linking and/or a cross-chain cyclization reaction occurs between the original polymer chain. At the lower temperature range of from about 150 to about 525 degrees C., the fibers are provided with a varying proportion of temporary to permanent set while in the upper range of temperatures of from 525 degrees C. and above, the fibers are provided with a permanent set.

It is to be understood that higher temperatures may be employed of up to about 1500 degrees C., but the most flexible and smallest loss of fiber breakage, when carded to produce the fluff, is found in those fibers and/or filaments heat treated to a temperature from about 525 and 750 degrees C.

The carbonaceous material which is utilized in the structures of this invention may be classified into three groups depending upon the particular use and the environment that the structures in which they are incorporated are placed.

In a first group, the non-flammable non-linear carbonaceous fibers are non-electrically conductive, such fibers when formed into a batting and coated according to the invention are suitable as insulation for sleeping bags, small boats, etc.

The term non-conductive as utilized in the present application relates to a resistance of greater than $10^7$ ohms per inch on a 6K tow formed from fibers having a diameter of 7–20 microns. When the precursor fiber is an acrylic fiber, it has been found that a nitrogen content of 18.8 % or more may result in a non-conductive fiber.

In a second group, the non-linear carbonaceous fibers are classified as being anti-static, slightly electrically conductive and having a carbon content of less then 85%. Low conductivity means that the 6K tow with the fibers has a resistance of about $10^7$–$10^4$ ohms per inch. When the precursor stabilized fiber is an acrylic fiber, i.e., a polyacrylonitrile based fiber, the percentage nitrogen content is from about 18 to 22% and preferably about 18.5%. These particular fibers when coated are excellent for use as insulation for personal articles where anti-static properties are desirous as well as insulation and buoyancy. The coated battings of the second group of fibers are useful as insulation in flight suits, jackets, in small aircraft to provide insulation, sound proofing and buoyancy, sports garments, floatation equipment, etc.

In a third group are the fibers having a carbon content of at least 85%. Preferably, the filaments which are utilized are derived from stabilized acrylic fibers and have a nitrogen content of less than 10%. As a result of the still higher carbon content, the structures prepared are more electrically conductive. That is, the resistance is less then $10^4$ ohms per inch. Moreover, the non-linear carbonaceous or carbon filaments when formed into a structure such as a mat or batting, provide better insulation against high heat than an equal weight of linear carbon fibers and have a moderate degree of durability. These fibers, as a result of their high carbon content, have superior thermal insulating characteristics. The coated structure in the form of a fluff provides a buoyant insulation which has good compressibility and resiliency while maintaining improved thermal insulating efficiency and electrical shielding and/or electrical grounding capability.

The precursor stabilized acrylic filaments which are advantageously utilized in preparing the fibers of the structures are selected from the group consisting of acrylonitrile homopolymers, acrylonitrile copolymers and acrylonitrile terpolymers. The copolymers preferably contain at least about 85 mole percent of acrylonitrile units and up to 15 mole percent of one or more monovinyl units copolymerized with styrene, methylacrylate, methyl methacrylate, vinyl chloride, vinylidene chloride, vinyl pyridine, and the like. Also, the acrylic filaments may comprise terpolymers, preferably, wherein the acrylonitrile units are at least about 85 mole percent.

The fluff or batting used in the invention may be treated either before or after coating with an organic or inorganic binder, needle punched, bagged or adhered to a flexible or rigid support using any of the conventional materials and techniques depending upon the ultimate use and environment of the structure.

The coating compositions which may be utilized to form the coating on the fibrous structure may be applied by any conventional means. The coating material may be applied by dipping, spraying, applied with rollers, and the like. The coating composition when applied need not cover the entire structure but preferably should be uniformly distributed. Suitably buoyant articles have been obtained wherein only the surface area of the fibrous structure is coated by spraying the coating material in an aerosol form.

It is understood that all percentages as herein utilized are based on weight percent.

Exemplary of the present invention are set forth in the following examples:

EXAMPLE 1

A. Preparation of Batting

A stabilized polyacrylonitrile PANOX (R. K. Textiles) continuous 3K or 6K, hereafter referred to as OPF, tow having nominal single fiber diameters of about 12 microns, was knit on a flat bed knitting machine into a cloth having from 3 to 4 loops per centimeter. Portions of this cloth were heat set at 750° C. in a nitrogen atmosphere over a 6 hour period. When the cloth was deknitted, it produced a tow which had an elongation or reversible deflection ratio of greater than 2:1. The deknitted tow was cut into various lengths of from 5 to 25 cm, and fed into a Platts Shirley opener. The fibers of the cut tow were separated by a carding treatment into a wool-like fluff, that is, the resulting product resembled an entangled wool-like mass or fluff in which the fibers had a high interstitial spacing and a high degree of interlocking as a result of the non-linear configuration of the fibers.

B. Coating Procedure

The batting of Part A was spread out and sprayed with an aerosol spray containing a fluoroalkane resin in a solvent comprising 1, 1, 1-trichloroethane sold under the trademark "SCOTCHGARD" by Household Products Division/3M. About 90% of the outside surface of the batting was coated. The batting was then air dried to cure the coating and weighed. The batting when placed in water for two hours floated. After two hours, the batting was shaken, squeezed and weighed. There was about 0.1% water absorbency.

The coated batting is suitable for use as a floatation aid and insulation for jackets and jumpsuits.

EXAMPLE 2

A 3K (i.e., 300 filaments) OPF PANOX stabilized tow was knit on a Singer flat bed knitting machine at a rate of 4 stitches/cm and was then heat treated at a temperature of 950 degrees C. The cloth was deknitted and the tow (which had a coil elongation or reversible deflection ratio of greater than 2:1) was cut into 7.5 cm lengths. The cut yarn was then carded on a Platt Miniature carding machine to produce a wool-like fluff having fibers ranging from 2.5 to 6.5 cm in length. The wool-like fluff had a high electrical conductivity (a resistance less then $10^4$ ohms per inch) over any length of up to 60 cm tested.

The fluff was coated by dipping into a bath containing a 20% solution of polyvinylidene fluoride in $1_1 1_1$ 1-trichloroethane. The fluff was removed and air dried. The dried fluff when placed into a water bath floated.

EXAMPLE 3

The coated wool-like fluff material of Example 2 was introduced as filling into a thermal jacket. The jacket employed about 5 ounces (0.14 kg) of the fluff as the sole fill of the jacket. The jacket had an insulating effect similar to that of a down jacket having 15–25 ounces (0.42– 0.71 kg) of down as the insulating fill. The jacket when placed into a water bath floated.

EXAMPLE 4

Two other jackets were filled with the coated mass of fibers of Example 2. In a first jacket the fibers used were a blend of the fibers of Example 2 and 25% of a synthetic polyester binder fiber which was thermally bonded to the fibers of Example 2. In a second jacket, the fibers used were the fibers of Example 2 with 20% thermally curable epoxy resin which was thermally cured. Both of the jackets contained about 15 oz (0.42 kg) of insulation material. Both jackets when worn and the wearer placed in a pool of water were buoyancy aids.

What is claimed is:

1. A buoyant low density open-celled fibrous structure which can be used for floatation and/or insulation comprising a coated batting, felt or non-woven web of resilient shape reforming elongatable non-linear carbonaceous fibers, said fibers having a reversible deflection ratio of greater than 1.2:1, and an aspect ratio greater than 10:1, said coating comprising a water insoluble hydrophobic cured or set substance.

2. The structure of claim 1 wherein said fibers have a sinusoidal configuration.

3. The structure of claim 1 wherein said fibers have a resistance of greater than $10^7$ ohms per inch when measured on a 6K tow formed from precursor fibers having a diameter of 7 to 20 microns and are non-electrically conductive fibers.

4. The structure of claim 3 wherein said fibers possess no anti-static characteristics.

5. The structure of claim 1 wherein said fibers have a resistance less than $10^4$ ohms per inch when measures on a 6K tow formed from precursor fibers having a diameter of 7 to 20 microns and are electrically conductive.

6. The structure of claim 1 wherein said coating comprises a member selected from the group consisting of ionomer, thermoset resin, thermoplastic resin, haloaliphatic resin, silicone elastomer, silicone rubber, polysiloxane and high molecular weight wax.

7. The structure of claim 6 wherein said coating is a haloaliphatic resin.

8. The structure of claim 6 wherein said coating is an ionomer.

9. The structure of claim 6 wherein said coating is a polysiloxane.

10. The structure of claim 1 which is surface coated.

11. In an article of clothing for insulating a party against the weather and providing buoyancy, the improvement which comprises said article having insulation material comprising a coated open-celled batting, felt or non-woven web of resilient, shape reforming elongatable non-linear carbonaceous fibers, said fibers having a reversible deflection ratio of greater than 1.2:1 and an aspect ratio greater than 10:1, said coating comprising a water insoluble hydrophobic cured or set substance.

12. The article of claim 11 wherein said coating comprises a member selected from the group consisting of ionomer, thermoset resin, thermoplastic resin, haloaliphatic resin, silicone elastomer, silicone rubber, polysiloxane and high molecular weight wax.

13. The article of claim 11 wherein said insulation comprises coil-like carbonaceous fibers.

14. The article of claim 11 wherein said insulation comprises sinusoidal carbonaceous fibers.

15. In a jacket having insulation, the improvement which comprises said insulation being composed of the structure of claim 1.

16. In a sleeping bag or blanket having insulation, the improvement comprising said insulation being composed of the structure of claim 1.

17. An insulation for an aircraft comprising the structure of claim 1.

18. The structure of claim 1 wherein said fibers have a resistance of about $10^7$ to $10^4$ ohms per inch when measured on a 6K tow formed from precursor fibers having a diameter of 7 to 20 microns and possess anti-static characteristics.

* * * * *